US005195064A

United States Patent [19]

Hegarty et al.

[11] Patent Number: 5,195,064

[45] Date of Patent: Mar. 16, 1993

[54] SOUND SUPPLEMENTED CLOCK SYSTEM

[75] Inventors: Brian A. Hegarty, 1420 Constellation Dr., Colorado Springs, Colo. 80906; David J. Fairfield, Colorado Springs, Colo.

[73] Assignee: Brian A. Hegarty, Colorado Springs, Colo.

[21] Appl. No.: 776,736

[22] Filed: Oct. 15, 1991

[51] Int. Cl.[5] ..... G04B 19/00; G04B 21/00

[52] U.S. Cl. ..... 368/272; 368/274

[58] Field of Search ..... 368/10, 72–75, 368/250, 251, 272–274; 369/23

[56] References Cited

U.S. PATENT DOCUMENTS

| | | | |
|---|---|---|---|
| 3,877,363 | 4/1975 | Parilla | 179/100.1 VC |
| 3,998,045 | 12/1976 | Lester | 368/63 |
| 4,073,133 | 2/1978 | Earls et al. | 368/273 |
| 4,245,336 | 1/1981 | Stietenroth | 368/75 |
| 4,271,495 | 6/1981 | Scherzinger et al. | 368/75 |
| 4,280,209 | 7/1981 | Mooney | 368/71 |
| 4,306,461 | 12/1981 | Grebe, Jr. | 73/861.12 |
| 4,368,989 | 1/1983 | Kawashima | 368/74 |
| 4,401,975 | 8/1983 | Ferguson et al. | 340/384 B |
| 4,437,380 | 3/1984 | Yamaguchi | 84/609 |
| 4,526,478 | 7/1985 | Makuta | 368/273 |
| 4,551,029 | 11/1985 | Aizawa | 368/273 |
| 4,557,266 | 12/1985 | Schober | 128/419 PG |
| 4,575,832 | 3/1986 | Takebe | 368/273 |
| 4,805,511 | 2/1989 | Schwartz | 84/1.22 |
| 4,878,028 | 10/1989 | Wang et al. | 328/55 |
| 4,896,308 | 1/1990 | Hwang | 368/75 |
| 4,998,075 | 3/1991 | Patton, III | 331/2 |

*Primary Examiner*—Vit W. Miska

*Attorney, Agent, or Firm*—Kinney & Lange

[57] ABSTRACT

A timekeeping system for providing selected ones of a plurality of audio signal portions, obtained from stored audio information, to be synchronized with selected time events even though the audio signal portions are of durations differing from one another. A rotator, operating with independent rotation timing, can be synchronized to the timing generator output signal by at least temporarily removing power from the rotator before the rotation period thereof drifts by more than a selected fraction of the period of the timing generator output signal. Further, the rotator rotation period for the angular rotation of the output structure can be effectively increased by selectively removing power from the rotator.

7 Claims, 9 Drawing Sheets

SOUND SUPPLEMENTED CLOCK SYSTEM

BACKGROUND OF THE INVENTION

The present invention relates to clocks having audio reproductions provided thereby and, more particularly, to clocks providing multiple displays and selected audio reproductions.

Music by machine, such as bell striker assemblies, music boxes and the like, has been used for centuries to annunciate the passage of increments of time. Typically, individual clocks providing such music have used a variety of mechanically or electronically generated audio passages to provide this result. For instance, the famous "Big Ben" at the Houses of Parliament in London, England, uses a centuries old mechanically actuated mechanism to strike bells in a prescribed sequence and at prescribed times to produce the well-known Westminster chimes. That clock mechanism enjoys distinction and fame primarily for two reasons: the particular music passage provided, and the particular sound characteristics of the bells used therein. Back to Renaissance times, and even before, equally distinctive clocks have been constructed in many countries of the world, each playing either a music specifically originated therefor, or playing music with a novel mechanical playing arrangement, or both. However, even though many clocks could play different musical compositions on the music playing arrangement therein, each was restricted to its music playing arrangement.

Typically, in conjunction with the annunciation of time increments by music, and also long before such annunciations, the passage of time increments was displayed by the analog movement of a structure ("hands") over some sort of dial face. Usually (until relatively recently), this was a mechanical arrangement using appropriate gearing to divide days into hours, hours into minutes, and minutes into seconds to an extent depending on the time resolution desired to be displayed. In nearly all of these arrangements, all of the analog structure used for movement in the displays, and everything needed to result in such movement, was operated by a single motor so that accurate synchronization between each element involved was preserved. This approach is efficient if only relatively simple gear arrangements are required, or if only a very small number of different time related displays are used. However, the method becomes cumbersome and expensive if more complex gear arrangements are required to display, for instance, the ordinary time of the day and, simultaneously, the position of the moon with respect to the earth. The use of mechanical gear arrangements also limits where the analog structures in the displays can be placed due to the requirement that all of the gears directly interact in some manner while being driven by a single rotary motion device, or motor, in conjunction with physical size limitations of the gears used. Thus, there is the desire for a clock system permitting access to a variety of different music passages from which to select one to annunciate increments of time, and to permit providing a variety of time related displays.

SUMMARY OF THE INVENTION

The present invention provides a timekeeping system for providing selected ones of a plurality of audio signal portions, obtained from stored audio information, to be synchronized with selected time events even though the audio signal portions are of durations differing from one another. The audio information is stored in a memory means as a plurality of duration data assemblages each corresponding to an audio signal portion and each comprising an audio data assemblage from which the audio signal portion can be obtained and a blank data assemblage which provides the remaining time for the duration data assemblage to fill a passage time duration of a selected length. A controller is capable of directing a memory means to provide the duration data assemblage at its output based on the number of cycles provided to the controller means from a timing signal generator having an output signal with cycles provided at a fundamental frequency.

The timekeeping system may also have a rotator having an output structure which is rotated at a selected angular value periodically if electrically energized. The rotator is operated through a power switch by the controller to selectively supply electrical power to the rotator which rotates the output structure typically for display purposes. The rotator, operating with independent rotation timing, can be synchronized to the timing generator output signal by at least temporarily removing power from the rotator before the rotation period thereof drifts by more than a selected fraction of the period of the timing generator output signal. Further, the rotator rotation period for the angular rotation of the output structure can be effectively increased by selectively removing power from the rotator.

The audio signal selections, obtained from audio information stored in a memory, is acquired by recording acoustic signals, removing unwanted components therefrom and storing the resulting audio signal portions as the audio data assemblages in the memory. Thus, thereafter selecting the audio signal selection desired leads to the appropriate audio data assemblage being retrieved in conjunction with a selected time event, determined from cycles in the timing signal, at a time fixed with respect to that time event.

DETAILED DESCRIPTION OF THE PREFERRED EMBODIMENTS

Figure 1:
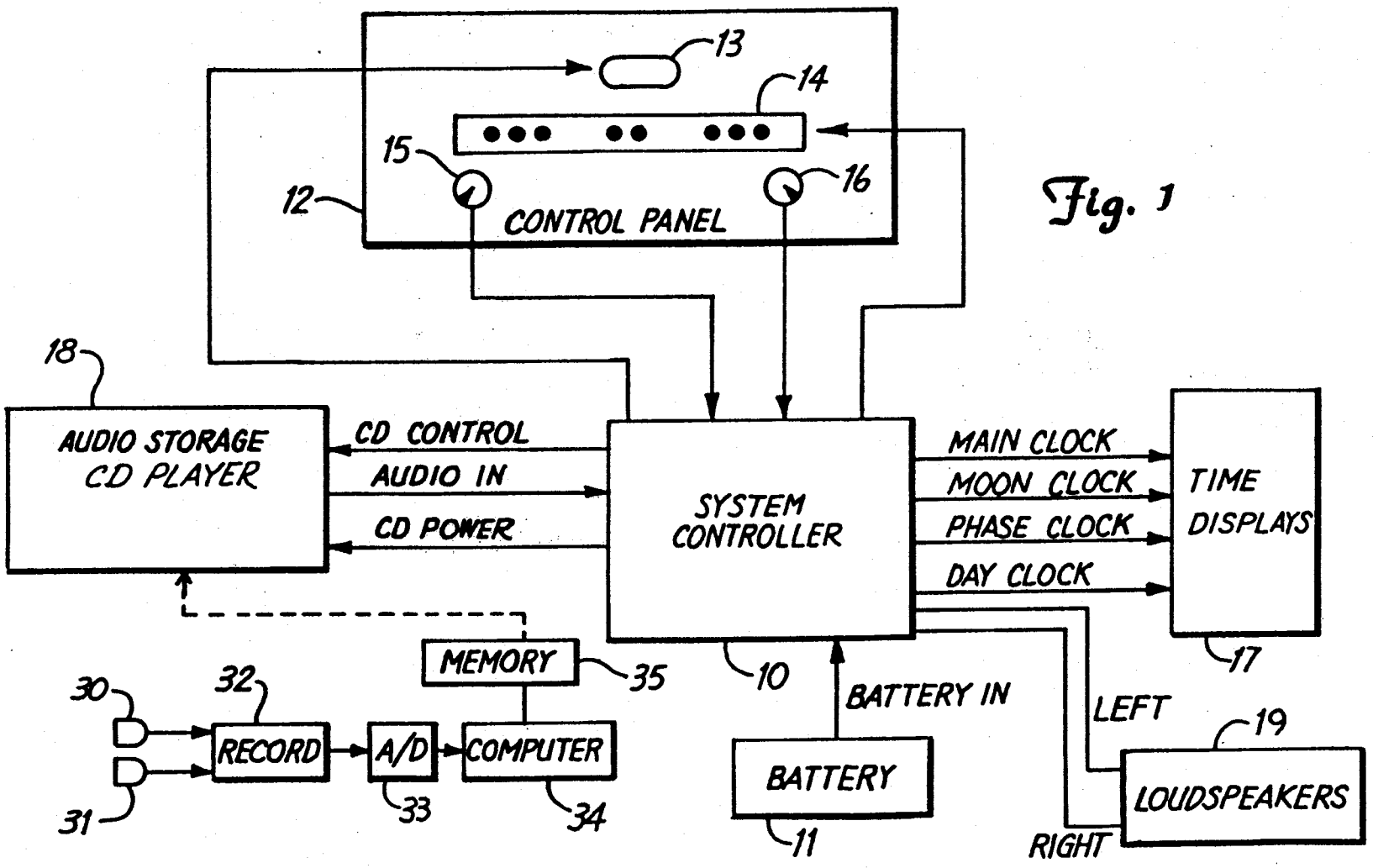
FIG. 1 is a block diagram of the timekeeping system of the present invention.

FIG. 1 shows a block diagram of the timekeeping system of the present invention including its audio system and its display arrangement. This timekeeping system is operated by a system controller, 10, and supplied electrical power through a battery system, 11, which can be continuously charged from an alternating current electrical power line if the user does not desire to operate on battery alone.

A user may provide commands to the system controller through a control panel, 12, having a liquid crystal (or other kind) digital display, 13, and a keypad, 14, which can receive manual circuit switching inputs from the user. A pair of potentiometer based day and night audio volume controls, 15 and 16, respectively, also accept manual commands from the user.

System controller 10 operates four different analog time displays, 17, including a main clock, a moon position clock, a moon phase clock, and a day of the week clock. System controller, 10, also operates the audio system including an audio information storage compact disc player 18, and three loudspeakers, 19.

Figure 2:
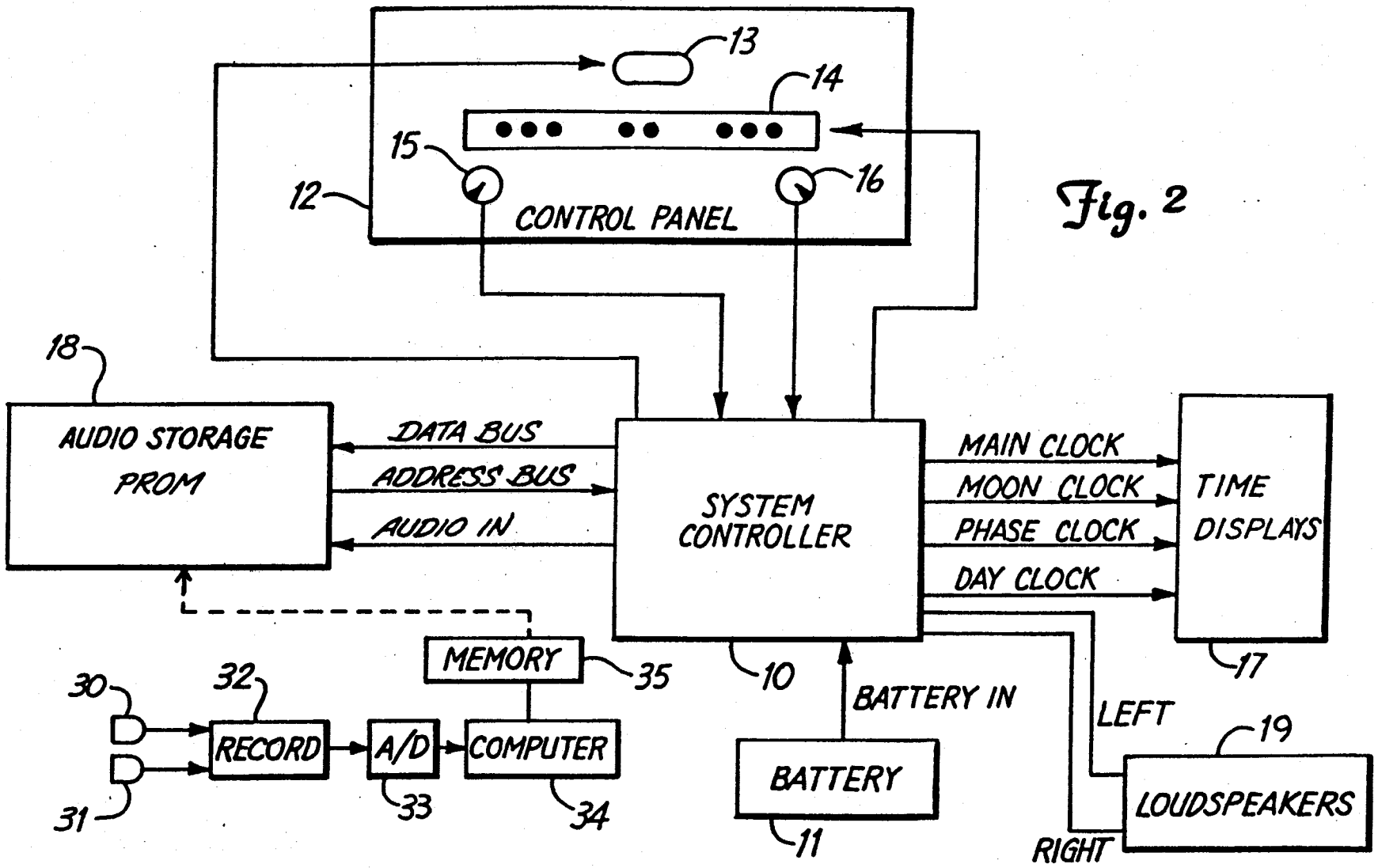
FIG. 2 is a block diagram of an alternate embodiment of the timekeeping system of the present invention.

FIG. 2 shows an alternative timekeeping system in which audio storage compact disc player 18 in FIG. 1 is replaced by an audio information storage programmable read-only memory, 18'. Some changes are required in system controller 10 to accommodate this audio information storage subsystem substitution, and the audio data stored must substantially different, but both in concept and implementation the accommodation is not too difficult. Similarly, other kinds of audio information storage systems could be used, such as tape or a computer hard disk, with suitable accommodations within the timekeeping system although no attempt will be made to also describe such other storage system types as they are also well known.

Any conventional compact disc player may be used as audio storage compact disc player 18 in which the electronic control apparatus for the player is accessible so that control signals can be supplied from system controller, 10, to manage and control that player. Similarly, any kind of programmable read-only memory may be used for audio storage programmable readonly memory 18' provided it has sufficient capacity and has sufficient operating speed to store and retrieve audio information data from which musical passages can be reproduced.

Loudspeakers 19 consist of two conventional mid-range loudspeakers and a conventional bass loudspeaker connected in a conventional arrangement to permit a pair of stereophonic analog audio signals to be supplied thereto for broadcast. Other circuit arrangements may or will be used therewith such as crossover circuits, equalizers or the like.

Figures 3, 7A, 7B:
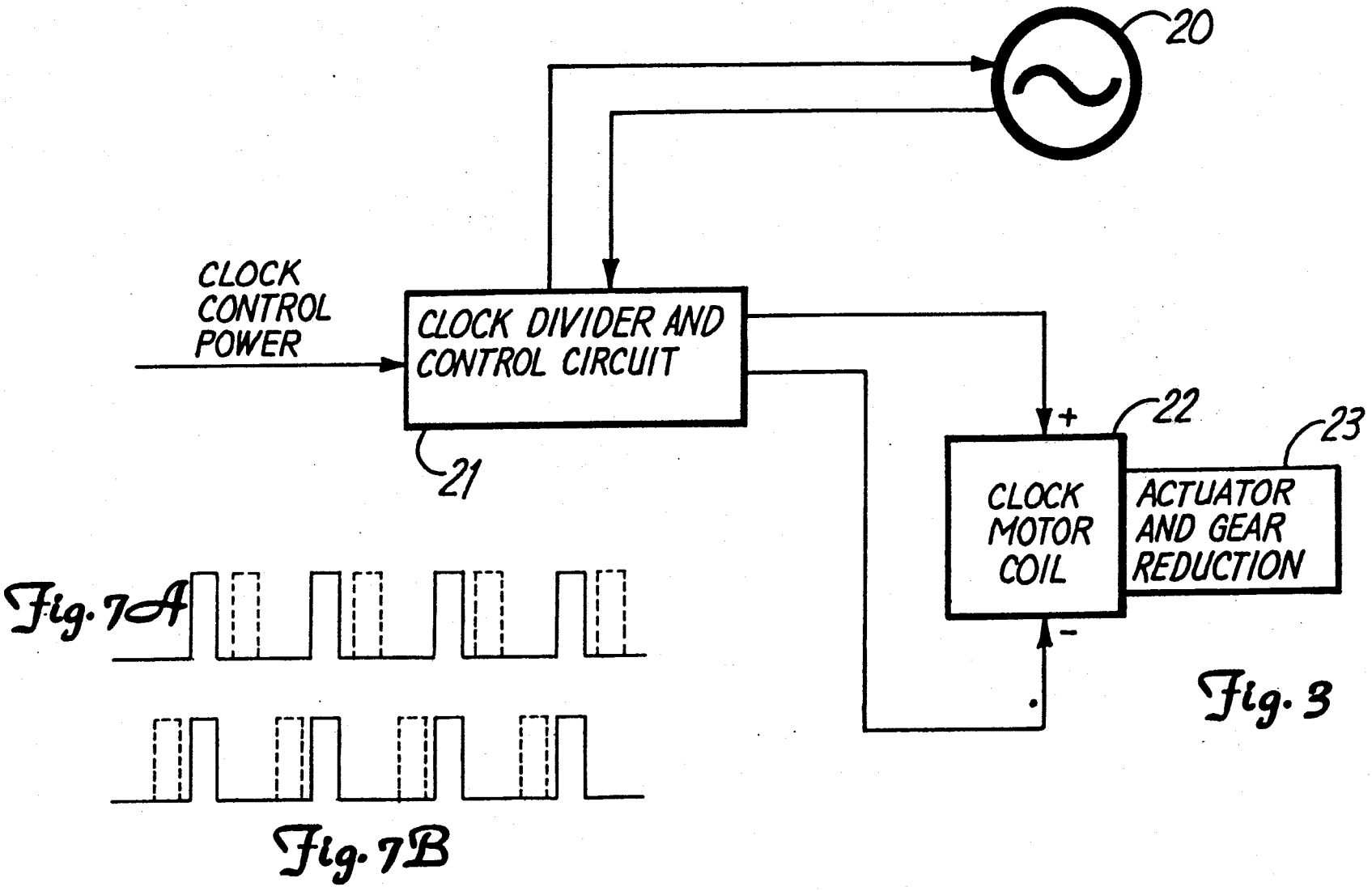
FIG. 3 is a block diagram of a subsystem used in the present invention.
FIGS. 7A and 7B show waveforms representing possible events occurring during use of the present invention.

FIG. 3 shows a clock motor and internal control arrangement forming an independently controlled clock motor for operating each of the analog time displays in analog display 17. One such independently controlled clock motor is used with each analog display (typically a driven mechanical indicator such as a minute hand, hour hand, dial carry pertinent pictorial scenes, or the like).

The independently controlled clock motor of FIG. 3 is a self-contained unit operated by its independent and self-generated time base formed by a crystal controlled oscillator, 20, therein having an oscillatory output signal with an oscillation frequency of 32.768 kHz. This oscillatory output signal is provided to a clock divider and control circuit, 21, which provides electrical power pulses alternating between two outputs which go to supply alternately positive current and negative current to a clock motor coil, 22. Thus, the upper output of circuit 21 in FIG. 3 provides an electrical power pulse to cause a positive electrical current to flow in the positive current flow direction in clock motor coil 22 every even numbered second, while the lower output of circuit 21 provides a electrical power pulse every odd second to cause negative current to flow in the negative current flow direction of the clock motor coil 22.

As a result, the magnetic field developed in clock motor coil 22 forces a rotor in an output actuator, 23, incorporating a gear reduction arrangement, to rotate a selected angular amount to in turn cause a corresponding movement of the motor second hand output shaft sufficient for an increment of one second. The gear reduction arrangement in actuator 23 rotates several output shafts at differing angular rotation rates, including concentrically mounted cylindrical shell output shafts. Thus, this output assembly arrangement in actuator 23 allows synchronous rotation of a second hand (completing a full rotation in a minute), a minute hand (completing a full rotation in a hour), and an hour hand (completing a full rotation in 12 hours) through the gear reduction arrangement having proper effective gear ratios of these output shafts with respect the rotor, and its two second period full rotations, due to its being directly driven by clock motor coil 22.

The independently controlled clock motor of FIG. 3 thus will operate continually if clock control power is provided to clock divider and control circuit 21, and so to oscillator 20. That is, the supplying of clock control power immediately (within milliseconds) causes the rotor in actuator 23 to rotate its standard angular amount corresponding to one second upon the motor coil receiving a suitable current pulse, and then causes the rotor to continue doing so every second thereafter. On the other hand, removal of the clock control power immediately prevents further motion of the rotor in actuator 23.

As indicated above, the passage of time increments is often annunciated with chimes, i.e. a musical interlude, followed, at least at the hour, by bell strikes in number sufficient to match the hour number. Thus, the audio system that is part of the timekeeping system of FIGS. 1 and 2, maintains stored audio information from which can be reproduced corresponding chimes, or musical interludes, and strikes. Because different compact discs can be used with audio storage compact disc player 18, and because different programmable read-only memories can be used for audio storage programmable read-only memory 18', the timekeeping system of FIGS. 1 and 2 has the ability to play recordings of a variety of chimes annunciating the passage of increments of time each associated with one of many different and, if desired, well known clocks. Alternatively, other kinds of music could be played.

Thus, the present invention provides for a far wider and richer variety of chimes, or other music, then has been heretofore available for a single clock. The use of interchangeable music storage media in player 18, or in memory 18', allows for a wide variety of chimes, or other music, that can be easily changed to suit the listener or environment, and thus provides the ability to control and adjust the ambiance of the environment by the choice of recorded chimes or other music.

Thus, to obtain recordings for publicly played chimes, or of clock chimes in museums or in private hands, the timekeeping systems of FIG. 1 and FIG. 2 obtain the corresponding audio information by first recording the acoustic signals from the clock and its musical annunciation arrangement through a pair of conventional monaural microphones, 30 and 31, in a standard electrical signal recording arrangement, 32.

The use of two microphones allows obtaining right and left audio information as the basis for providing stereophonic reproductions of those signals.

Rather than use both microphones 30 and 31, an alternative method is to use a single directional microphone to obtain a single monaural signal, and then form a second signal therefrom which is delayed typically 25 to 30 milliseconds from the first recorded signal to simulate some acoustic signals reaching the listener later than others due to reflections from buildings and the like. Such an arrangement may well provide a more realistic experience for the listener than the use of two monaural microphones as the basis for providing a stereophonic reproduction result.

The raw recorded audio information signals from the acoustic signals recorded in recorder 32 can then be later converted to digital signal form by an analog-to-digital converter, 33, and then sent to a computer, 34, to remove unwanted components from these signals. Such unwanted components in publicly recorded acoustic signals may include street noises, birds, mechanical movement noises from the clock or associated music provision arrangement, and the like.

This unwanted signal component removal can be done in alternative ways, including recording the same chimes at different times, and thereafter correlating between the various recordings using averaging methods to keep the signals which are common to each and to eliminate spurious signals present in each. Another way is to have one familiar with audio reproduction look at the frequency spectrum of the recorded acoustic chime signals and eliminate clearly unwanted components recognized by that person.

The audio signals remaining after removal of unwanted components are either stored in the computer, or stored in another memory means, or an electrical signal recording means, 35. From there, the audio information captured in signal recording means or memory 35 must be stored appropriately in compact discs or programmable read-only memories for use in player 18 or in memory 18'. However, significant problems arise in doing so where the recorded chime audio signals involve a broad array of chime selections each with different time durations and timing requirements.

For instance, some well known clocks chime each quarter hour while others sound only each hour, and some sound only every third hour. Some well known clocks have chimes of long durations while others are of rather short duration. Further, it is very important to allow interchangability among various compact discs containing data for different chimes, or among various programmable read-only memories containing data for different chimes, but any of which must play in the timekeeping systems of FIGS. 1 and 2 at exactly the correct time to correctly annunciate the passages of increments of time.

In order to have consistency among different chime selections, a convention must be chosen relating to whether such musical annunciation of a time increment begins at, or ends at, the time event separating one increment from the next. For instance, music selections for the first quarter hour following an hour could begin at exactly 15 minutes after the hour, or could begin earlier so that they end exactly 15 minutes after the hour. Herein, we will describe a system which uses the latter convention of ending prior to time events indicating separations between adjacent time increments, but the alternative convention could just as well have been used.

Again, on the hour, many chimes play music followed by striking the number of hours at that time. Typically, the first strike marks the exact hour, and that is the convention chosen in the following description but an alternative could just as well be used. Such convention choices affect the particular formats followed in providing and playing chime selection tracks on a compact disc, and in locating and retrieving chime data in programmable read-only memories. Hence, the conventions must be kept the same so that compact discs with chime data are interchangeable, and so that programmable read-only memories with chime data are interchangeable, while preserving timing accuracy.

To provide a large range of chime, or musical interlude, choices on one compact disc or in one programmable read-only memory, the particular format chosen and described herein accommodates four chimes and three melodies. Other compact disc formats, or programmable read-only memory formats, could alternatively have been chosen containing a greater or lesser number of chimes depending on the size and cost of the particular memory storage system used. Each time a chime or musical interlude is to be played in connection with a time event, the computer instructs player 18 to go to a particular track or series of tracks on the compact disc therein which contains the music for that time event in the compact disc example to be described here. Since the timekeeping system of FIGS. 1 and 2 will not be able to distinguish between alternative disc formats, the same disc format must be maintained for every disc of alternative chimes, or musical interludes, to be developed thereafter for use in the system of FIGS. 1 and 2. This disc format is represented in the following tabulation:

| | | Chime Selection | | | | | | | | | |
|---|---|---|---|---|---|---|---|---|---|---|---|
| Time | | 1 | 1C | 1H | 2 | 2C | 2H | 3 | 3C | 3H | 4 |
| 12o'c | 14:40 | | | | | | | 60 | 60 | | |
| | 14:53 | 4 | 4 | | 32 | 32 | | | | | |
| | 29:10 | | | | | | | 61 | 61 | | |
| | 29:45 | 5 | 5 | | 33 | 33 | | | | | |
| | 44:40 | 6 | 6 | | 34 | 34 | | 62 | 62 | | |
| | 59:00 | | | | | | | 63 | 63 | | |
| | 59:15 | | | | | | | | | | 76 |
| | 59:30 | 8 | 7 | 8 | 36 | 35 | 36 | | | | |
| | 59:59 | | | | | | | 64 | | 64 | |
| | — | | | | | | | | | | |
| 1o'c | 14:40 | | | | | | | 60 | 60 | | |
| | 14:53 | 4 | 4 | | 32 | 32 | | | | | |
| | 29:10 | | | | | | | 61 | 61 | | |
| | 29:45 | 5 | 5 | | 33 | 33 | | | | | |
| | 44:40 | 6 | 6 | | 34 | 34 | | 62 | 62 | | |
| | 59:00 | | | | | | | 63 | 63 | | |
| | 59:15 | | | | | | | | | | 77 |
| | 59:30 | 10 | 7 | 10 | 38 | 35 | 38 | | | | |
| | 59:59 | | | | | | | 65 | | 65 | |
| | — | | | | | | | | | | |
| 2o'c | 14:40 | | | | | | | 60 | 60 | | |
| | 14:53 | 4 | 4 | | 32 | 32 | | | | | |
| | 29:10 | | | | | | | 61 | 61 | | |
| | 29:45 | 5 | 5 | | 33 | 33 | | | | | |
| | 44:40 | 6 | 6 | | 34 | 34 | | 62 | 62 | | |
| | 59:00 | | | | | | | 63 | 63 | | |
| | 59:15 | | | | | | | | | | 78 |
| | 59:30 | 12 | 7 | 12 | 40 | 35 | 40 | | | | |
| | 59:59 | | | | | | | 66 | | 66 | |
| | — | | | | | | | | | | |
| 3o'c | 14:40 | | | | | | | 60 | 60 | | |
| | 14:53 | 4 | 4 | | 32 | 32 | | | | | |
| | 29:10 | | | | | | | 61 | 61 | | |
| | 29:45 | 5 | 5 | | 33 | 33 | | | | | |

-continued

| Time | | Chime Selection 1 | 1C | 1H | 2 | 2C | 2H | 3 | 3C | 3H | 4 |
|---|---|---|---|---|---|---|---|---|---|---|---|
| | 44:40 | 6 | 6 | | 34 | 34 | | 62 | 62 | | |
| | 59:00 | | | | | | | 63 | 63 | | |
| | 59:15 | | | | | | | | | | 79 |
| | 59:30 | 14 | 7 | 14 | 42 | 35 | 42 | | | | |
| | 59:59 | | | | | | | 67 | | 67 | |
| | — | | | | | | | | | | |
| 4o'c | 14:40 | | | | | | | 60 | 60 | | |
| | 14:53 | 4 | 4 | | 32 | 32 | | | | | |
| | 29:10 | | | | | | | 61 | 61 | | |
| | 29:45 | 5 | 5 | | 33 | 33 | | | | | |
| | 44:40 | 6 | 6 | | 34 | 34 | | 62 | 62 | | |
| | 59:00 | | | | | | | 63 | 63 | | |
| | 59:15 | | | | | | | | | | 80 |
| | 59:30 | 16 | 7 | 16 | 44 | 35 | 44 | | | | |
| | 59:59 | | | | | | | 68 | | 68 | |
| | — | | | | | | | | | | |
| 5o'c | 14:40 | | | | | | | 60 | 60 | | |
| | 14:53 | 4 | 4 | | 32 | 32 | | | | | |
| | 29:10 | | | | | | | 61 | 61 | | |
| | 29:45 | 5 | 5 | | 33 | 33 | | | | | |
| | 44:40 | 6 | 6 | | 34 | 34 | | 62 | 62 | | |
| | 59:00 | | | | | | | 63 | 63 | | |
| | 59:15 | | | | | | | | | | 81 |
| | 59:30 | 18 | 7 | 18 | 46 | 35 | 46 | | | | |
| | 59:59 | | | | | | | 69 | | 69 | |
| | — | | | | | | | | | | |
| 6o'c | 14:40 | | | | | | | 60 | 60 | | |
| | 14:53 | 4 | 4 | | 32 | 32 | | | | | |
| | 29:10 | | | | | | | 61 | 61 | | |
| | 29:45 | 5 | 5 | | 33 | 33 | | | | | |
| | 44:40 | 6 | 6 | | 34 | 34 | | 62 | 62 | | |
| | 59:00 | | | | | | | 63 | 63 | | |
| | 59:15 | | | | | | | | | | 82 |
| | 59:30 | 20 | 7 | 20 | 48 | 35 | 48 | | | | |
| | 59:59 | | | | | | | 70 | | 70 | |
| | — | | | | | | | | | | |
| 7o'c | 14:40 | | | | | | | 60 | 60 | | |
| | 14:53 | 4 | 4 | | 32 | 32 | | | | | |
| | 29:10 | | | | | | | 61 | 61 | | |
| | 29:45 | 5 | 5 | | 33 | 33 | | | | | |
| | 44:40 | 6 | 6 | | 34 | 34 | | 62 | 62 | | |
| | 59:00 | | | | | | | 63 | 63 | | |
| | 59:15 | | | | | | | | | | 83 |
| | 59:30 | 22 | 7 | 22 | 50 | 35 | 50 | | | | |
| | 59:59 | | | | | | | 71 | | 71 | |
| | — | | | | | | | | | | |
| 8o'c | 14:40 | | | | | | | 60 | 60 | | |
| | 14:53 | 4 | 4 | | 32 | 32 | | | | | |
| | 29:10 | | | | | | | 61 | 61 | | |
| | 29:45 | 5 | 5 | | 33 | 33 | | | | | |
| | 44:40 | 6 | 6 | | 34 | 34 | | 62 | 62 | | |
| | 59:00 | | | | | | | 63 | 63 | | |
| | 59:15 | | | | | | | | | | 84 |
| | 59:30 | 24 | 7 | 24 | 52 | 35 | 52 | | | | |
| | 59:59 | | | | | | | 72 | | 72 | |
| | — | | | | | | | | | | |
| 9o'c | 14:40 | | | | | | | 60 | 60 | | |
| | 14:53 | 4 | 4 | | 32 | 32 | | | | | |
| | 29:10 | | | | | | | 61 | 61 | | |
| | 29:45 | 5 | 5 | | 33 | 33 | | | | | |
| | 44:40 | 6 | 6 | | 34 | 34 | | 62 | 62 | | |
| | 59:00 | | | | | | | 63 | 63 | | |
| | 59:15 | | | | | | | | | | 85 |
| | 59:30 | 26 | 7 | 26 | 54 | 35 | 54 | | | | |
| | 59:59 | | | | | | | 73 | | 73 | |
| | — | | | | | | | | | | |
| 10o'c | 14:40 | | | | | | | 60 | 60 | | |
| | 14:53 | 4 | 4 | | 32 | 32 | | | | | |
| | 29:10 | | | | | | | 61 | 61 | | |
| | 29:45 | 5 | 5 | | 33 | 33 | | | | | |
| | 44:40 | 6 | 6 | | 34 | 34 | | 62 | 62 | | |
| | 59:00 | | | | | | | 63 | 63 | | |
| | 59:15 | | | | | | | | | | 86 |
| | 59:30 | 28 | 7 | 28 | 56 | 35 | 56 | | | | |
| | 59:59 | | | | | | | 74 | | 74 | |
| | — | | | | | | | | | | |
| 11o'c | 14:40 | | | | | | | 60 | 60 | | |
| | 14:53 | 4 | 4 | | 32 | 32 | | | | | |
| | 29:10 | | | | | | | 61 | 61 | | |

-continued

| Time | Chime Selection 1 | 1C | 1H | 2 | 2C | 2H | 3 | 3C | 3H | 4 |
|---|---|---|---|---|---|---|---|---|---|---|
| 29:45 | 5 | 5 | | 33 | 33 | | | | | |
| 44:40 | 6 | 6 | | 34 | 34 | | 62 | 62 | | |
| 59:00 | | | | | | | 63 | 63 | | |
| 59:15 | | | | | | | | | | 87 |
| 59:30 | 30 | 7 | 30 | 58 | 35 | 58 | | | | |
| 59:59 | | | | | | | 75 | | 75 | |
| — | | | | | | | | | | |

In the first column to the left in this tabulation, there is listed the sequence of hours, giving all 12 hours for which a different number of strikes must be provided on the hour. Thus, the twelve hour sequence will repeat twice a day as is typical of most clocks.

In the next column to the right, there is provided a list of times in minutes and seconds following that hour at each of which, in this chosen format, playing of attack on the compact disc is permitted to begin while satisfying the timing selected for the format. Thus, there are nine total possible starting times for the beginning of playing a track on the compact disc following 12 o'clock prior to one o'clock, these first being two times, 12:14:40 and 12:14:53, which are associated with the first quarter hour time event separating that quarter hour from the second quarter hour. Two further times are permitted for starting play of tracks associated with the half hour, these times being 12:29:10 and 12:29:45. There is but a single time to start a track in association with the three-quarter hour point, that being 12:44:40.

Because of the often more elaborate music selections associated with the hour typical of many clocks, there are four alternative times at which a track could begin to play in association with the coming of the next hour of 1 o'clock. These four times are 12:59:00, 12:59:15, 12:59:30, and 12:59:59. Similar arrangements are provided for each of the other hours, 1 o'clock through 11 o'clock.

The next three columns represent alternatives in the first chime, or musical interlude, series provided on a compact disc, each involving the same basic musical melody selection but with a different amount of usage or with a difference in the strikes noting the hour. Thus, for this first musical melody choice, the selections under column 1 provide corresponding musical melody aspects for the quarter hour event on track 4, for the half hour event on track 5, and for the three-quarter hour event on track 6. The hour time event musical selection also contains the number of strikes appropriate to the particular hour, so that different track is associated each hour point to accommodate the different number of strikes.

Under column 1C, the same tracks are begun for the quarter hour event, the half hour event, and the three-quarter hour event. However, a single track, track 7, is used in connection with each hour event since, in this variant, the strikes are not sounded for the hour. Under column 1H, chimes are sounded only on the hour and carry the strikes with them, and so the associated tracks match the corresponding tracks under column 1.

Columns 2, 2C, and 2H represent the same kind of track and start time arrangement, but for a different chime or musical selection. The chime selection under columns 3, 3C, and 3H are also similar except that they provide for a silent space between the end of the musical interlude for the hour in track 63 and the sounding of the strikes in track 64 when approaching the hour such 1 o'clock. That is, rather than the overlap which possible between the musical melody and the strikes in the first and second chime series, this third chime series clearly separates the strikes from the musical selection, or eliminates them altogether under column 3C, or provides for only the strikes under column 3H. This is an appropriate arrangement for carillons.

The last chime, or musical selection appears under Column 4. In this selection, only a musical melody with, and strikes on, the hour are permitted.

In more detail, the first two chime series accommodate chimes with the following characteristics:

1) these series contain musical selections for up to four different quarter hour time events, and if the clock has no music in some or several of the quarters, then the tracks still exist for those quarters to satisfy the format but would contain only silence data. That is, the compact disc player 18 is directed by system controller 10 to play a track designated for a particular time even if the chimes selected for some discs do not have any music data corresponding thereto in the tracks chosen for those time slots;

2) the first quarter hour music is no longer then seven seconds excluding any decay of the last note;

3) the second quarter hour music is no longer then 15 seconds again excluding any decay of the last note;

4) the three-quarter hour music is no longer then 20 seconds, once again excluding any decay of the last note;

5) the fourth quarter hour music is no longer then 30 seconds excluding the striking of the hours;

6) the sound of the music that precedes the striking of the hour bell has not died out before the hour strikes start (if they exist), and therefore the fourth quarter hour music and striking bells must be on the same track;

7) the length of the hourly strike is unrestricted (if they exist); and 8) musical tones can be substituted for (or added to) the hourly strikes.

Research has indicated that most progressive chimes will be able to fit within these criteria.

The third chime series accommodates chimes with the following characteristics:

1) the chimes contain up to four quarter hours of music, and if the clock has no music in some or several of the quarter hours, then the tracks would still exist for those quarter hours but would contain only silence data;

2) the first quarter hour music is no longer then 15 seconds excluding the decay of the last note;

3) the second quarter hour music is no longer then 1 minute and allows for a strike tone at exactly the half hour;

4) the three-quarter hour music is no longer then 20 seconds excluding any decay of the last note;

5) the fourth quarter hour music is no longer then 50 seconds, not including the striking of the hours (if they exist);

6) the sound of the music that precedes the striking of the hour bell has died out before the hour strikes start (if they exist), and therefore the fourth quarter hour music and striking bells need not be on the same track; and 7) the length of the hourly strikes is unrestricted (if they exist).

Again, research indicates that many carillons will meet these criteria.

Finally, the fourth chime series accommodates chimes that play only on the hour, which is typical of many historical music house clocks. The following characteristics are permitted:

1) the chimes music plays only on the hour;

2) the chimes music can play a different tune each hour;

3) the chimes music tunes are no longer then 50 seconds excluding any decay of the last note; and 4) the chimes music is played before the hour and may finish with a strike tone or bell designating the number of the hour, the first strike of which is played exactly on the hour.

The chimes selection over these four formats taken together, as given in the compact disc format described in the tabulation above, will allow the flexibility for playing the chimes of the vast majority of chime playing clocks ever produced. However, while the above compact disc format provides a flexibility for playing such a variety of chimes, the format does not by itself accommodate the differences between the allowed times for playing under the format and the actual times of playing of any particular chime chosen to be placed on the compact disc within the format criteria. Rather, this accommodation is made by the placement of intentional silence data at the beginning of each track on the disc of such a length that the total time of that track meets the maximum allowed time under the compact disc format set out above.

For instance, in the first series of chimes, the chime passage associated with the first quarter hour event following the hour event is permitted to last for up to 8 seconds, and so the disc player will always be instructed by system controller 10 to start playing 10 seconds before the occurrence of the exact 15 minute time event following the hour, i.e. the first quarter hour following the hour, when the user has selected chime 1. Assume that on the first disc, the chime passage associated with the first quarter hour that is recorded as chime 1 lasts in actual playing time for only 4 seconds, and so the audio information data for that 4 seconds is recorded in that track. Then, in order that the musical melody end exactly on the quarter hour, silence data for 3 seconds must be added at the beginning of the track preceding that audio information, or music, data.

If the chime that is recorded on another compact disc as chime 1 has, for instance, audio information data in the corresponding hour event track which will lead to 6 seconds playing of a musical melody, then 1 seconds of silence data must be added to that track so that the track playing time reaches the format playing time permitted of 10 seconds.

This use of silence data in the tracks is particularly important in the fourth quarter hour so that the hour strike, if present, strikes exactly on the hour. In many instances, musical clocks play a short tune immediately prior to the hour followed by an hour bell that strikes exactly on the hour. In chime series 1 in the above table, the maximum length permitted for the fourth quarter hour musical selection preceding the hour is 30 seconds, and compact disc player 18 will always start playing 30 seconds before the hour. (Of course, the switching on of compact disc player 18 and getting the disc up to speed, and the like, will begin more then 30 seconds before the hour.) Since the fourth quarter hour musical selection and the hourly strikes are on the same track on the compact disc, the timing of the start of the tune must be adjusted such that the hour strike occurs exactly on the hour. This is again accomplished by adding silence data to the beginning of the track of an appropriate duration.

If the time from the start of the fourth quarter hour musical melody to the first strike is, as an example, 22 seconds, then 8 seconds of silence data must be added to the beginning of the track for that chime. All of these silences are a critical part of the composition and editing of each track on each compact disc.

Figure 4:
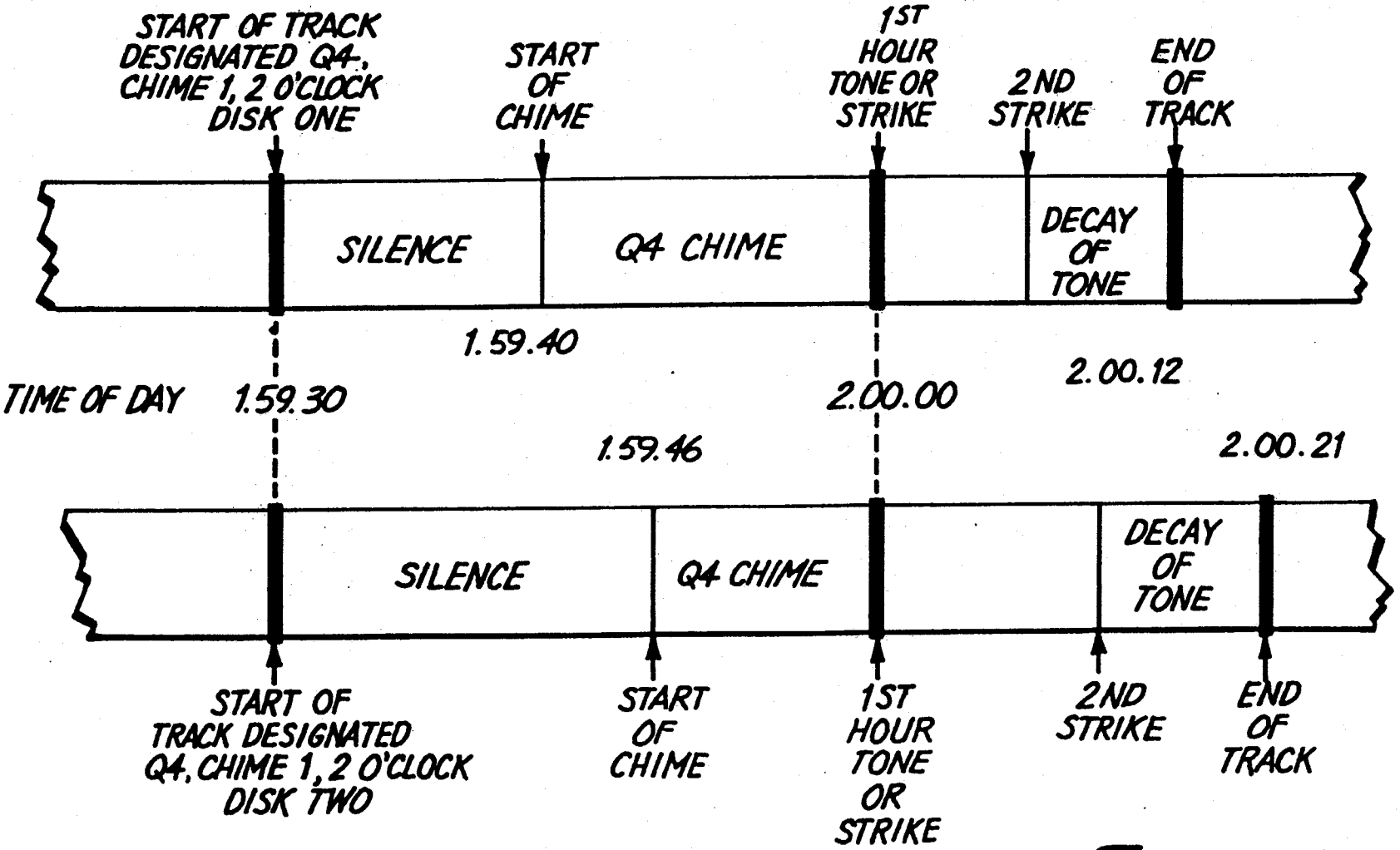
FIG. 4 is a representation of a possible situation in a subsystem used in the present invention.

The example of the methodology described above for two different chime selections as chime 1 on two different discs is shown diagrammatically in FIG. 4 for the two different chimes, or musical selections, each entered as the same chime number 1 but on two different discs with the pertinent track portion from each being represented in that figure. The example shows the situation on approaching 2 o'clock. Both of the differing musical selections, as stated, are on the same numbered track (track 10) on their respective discs, and compact disc player 18 will be directed by system controller 10 to start playing that track at exactly 1:59:30 for each compact disc in accord one of the permitted start times for the fourth quarter hour following 1 o'clock in the above table.

However, the musical selection prelude to the hour in the case of the chime on the top disc in FIG. 4 is longer then its counterpart in the bottom disc shown there, 20 seconds on the top compared to 14 seconds on the bottom. Therefore, to have the hourly strike tone, or bell, strike exactly on the hour in both chimes, a compensating period of silence data is added to the track prior to the beginning of the musical selection in each of such a duration that the total time between the start of the track (1:59:30) and the first hour strike note is exactly 30 seconds. Thus, there is 10 seconds of silence data added after 1:59:30 in the upper track, and 16 seconds of silence data added after the 1:59:30 point on the lower track.

As can also be seen, the subsequent additional strikes and their duration, including their decays is not restricted by the disc format or the timing methodology, and does not require any coordination between the discs, subject to available disc data space. Thus, this formatting and timing arrangement allows recorded music from a wide variety of quite different clock music arrangements to be played on the one timekeeping system in either of FIGS. 1 or 2.

Figure 5:
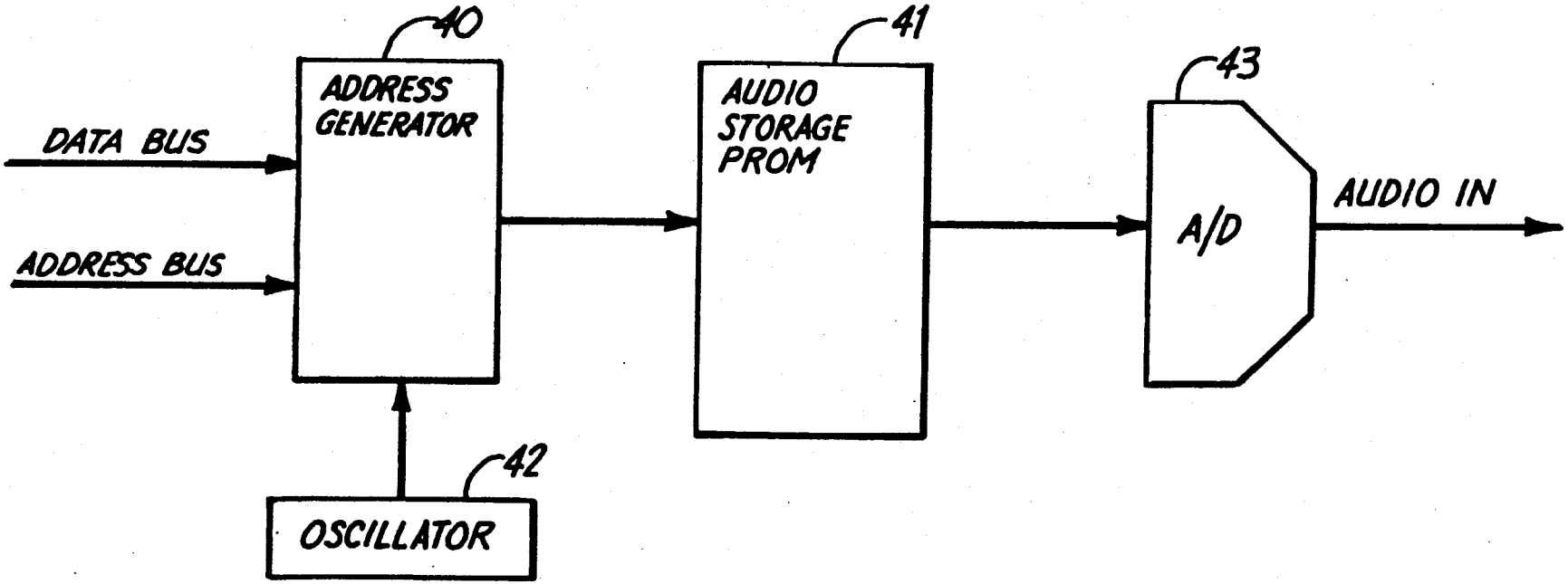
FIG. 5 is a block diagram of a subsystem useable in the present invention.

In the system of FIG. 2, audio storage programmable read-only memory 18' is shown as a subsystem concerning which greater detail is shown in FIG. 5. A random access memory, 40, serves as an address generator to provide a sequence of addresses to an audio storage programmable read-only memory, 41. System controller 10 provides on the address bus extending therefrom to memory 40 a starting address for the audio information data in a chime passage, and a stop address therefor, between which the selected chime audio data is stored in audio storage programmable read-only memory 41. Address generator 40 then provides all of the addresses in between these start and stop addresses to audio storage programmable read-only memory 41, one address being so provided with each cycle of an oscillator, 42, in its oscillatory output signal provided to address generator 40 which signal contains an oscillation frequency of 44.1 kHz.

The chime audio information data in the memory location at each such address supplied to audio storage programmable read only memory 41 by memory 40 is sequentially supplied to its output, and from there this data is in turn supplied to an analog-to-digital converter, 43, to provide the analog audio information output signal AUDIO IN. Thus, system controller 10 can control the timing of initiating the presentation of, and the selection of, audio data from a semiconductor memory as well as from a compact disc player.

Figure 6A:
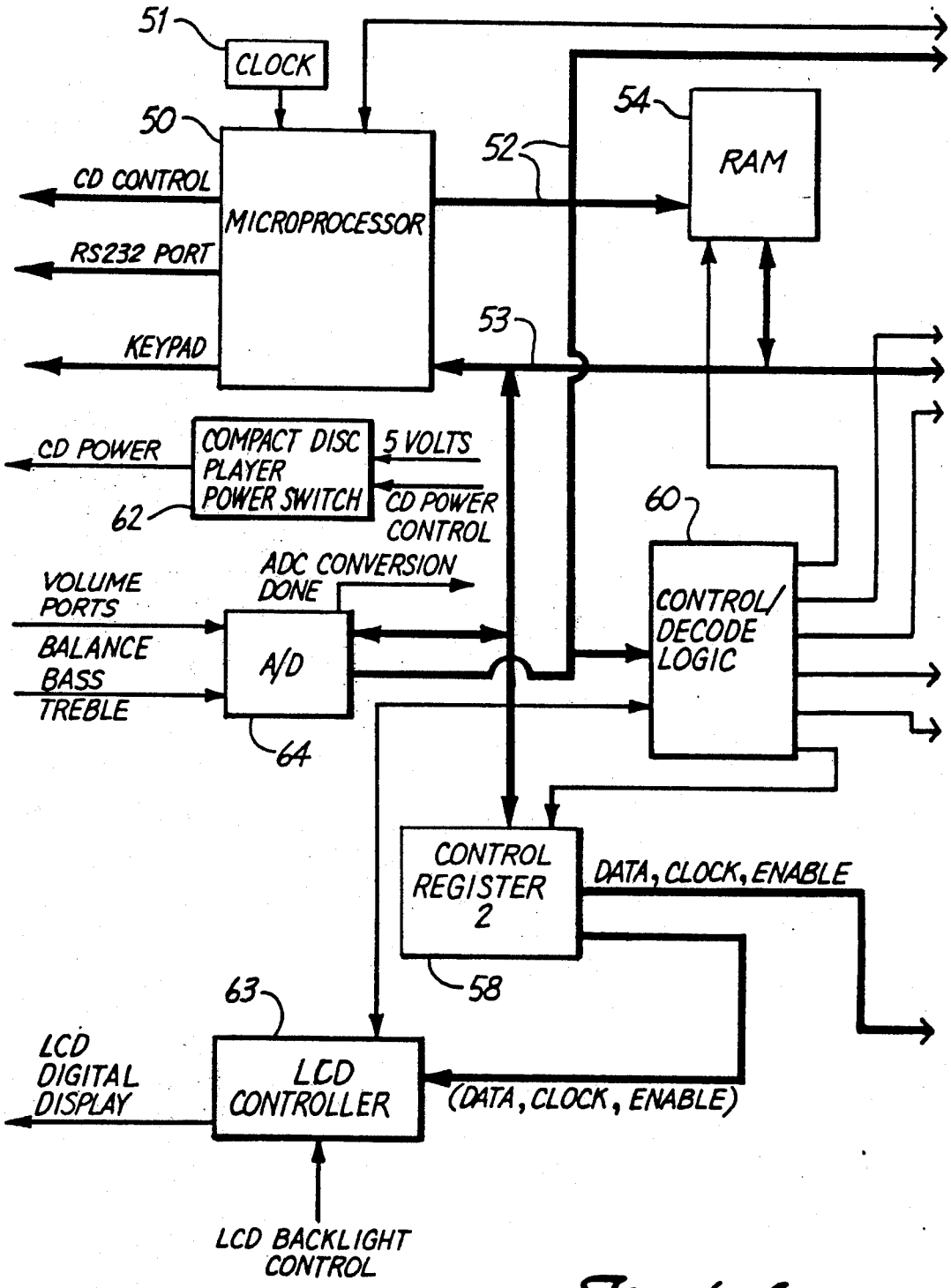
FIGS. 6A and 6B are a block diagram of a subsystem used in the present invention.
Figure 6B:
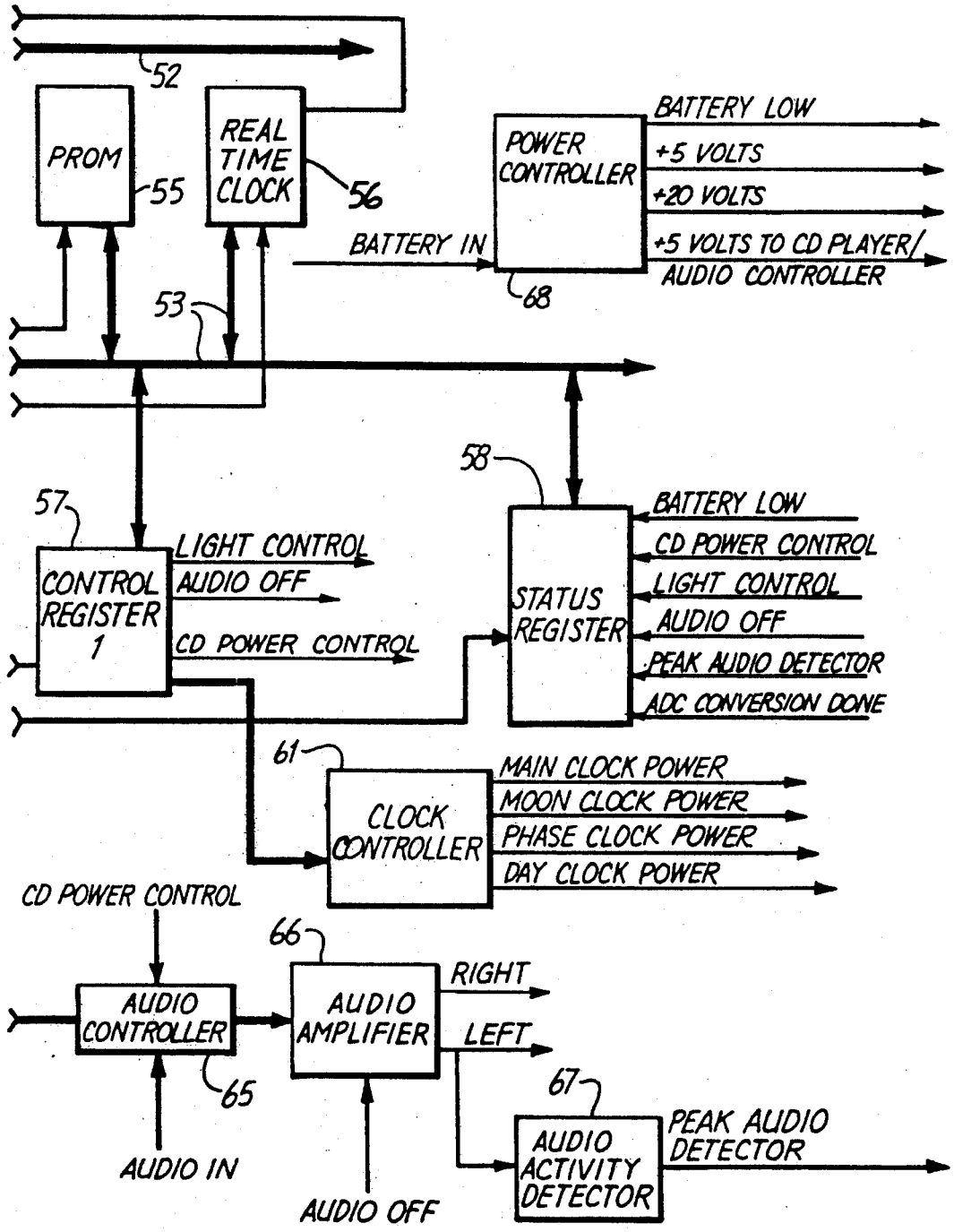

System controller is shown in greater detail in the block diagram of FIGS. 6A and 6B for the situation of using a compact disc player for storage of audio information rather than a semiconductor memory. A microprocessor, 50, in FIG. 6A is used to control and manage the operation of the timekeeping system shown in FIGS. 1 and 2. Microprocessor 50 is operated on a time base set by a clock, 51, i.e. a crystal controlled oscillator, which provides an oscillatory output signal to microprocessor containing oscillations at a rate of 4.1952 MHz thereby enabling microprocessor 50 to execute commands at a rate proceeding 1.0 MHz.

Microprocessor 50 is connected to an address bus, 52, and a data bus, 53. Address bus 52 is a 16 bit bus, and data bus 53 is an 8 bit bus. The arithmetic logic unit of the microprocessor 50 is an 8 bit unit.

Keyboard 14 in control panel 12 is connected to a port in microprocessor 50 by an 8 bit bus to allow parallel operation. Audio storage compact disc player 18 is connected to microprocessor 50 by a single line for serial communication to player 18. Finally, microprocessor 50 has a port meeting the RS232 standard for serial communication, this being usable for connection with an external computer for analysis purposes to permit loading the timekeeping system program into that computer and permitting automated circuit analysis.

System controller 10 uses a random-access memory, 54, for temporary storage of variables being calculated or used by microprocessor 50. Such variables include the current time, copies of the contents or registers used in the timekeeping system, and storage of variables for various program needs in the performance by microprocessor 50 of the program operating the timekeeping system. Random-access memory 54 is a static random access memory configured on an 8k $\times$8 bit basis.

The address port of random-access memory 54 are connected to address bus 52, and the data port of is connected to data bus 53. In addition, power is supplied to random-access memory 54 through a capacitor and diode arrangement such that the absence of power on the power supply lines results in the capacitor supplying electric power to the memory until discharged. Thus, if electrical power is removed from across the timekeeping system circuitry or if a low battery voltage condition has been detected resulting in the reduction by the system of voltage across the system, random-access memory 54 will continue to store the state of the system registers. As a result, microprocessor 50, once full power is restored to the timekeeping system circuitry, can obtain the previous timekeeping system register condition at the time of power loss and restore the timekeeping system circuit to that condition.

Microprocessor 50 is also connected to a further memory in FIG. 6B, this being a programmable read-only memory, 55, which is also configured on an 8k $\times$8 bit basis. This memory contains all of the program information for microprocessor 50 as well as several control tables. These control tables include the serial commands for audio storage compact disc play 18, the formatting tables involving chime or musical start times and the chime or music selection compact disc tracks, or programmable read-only memory start and stop addresses, for the various chimes. In addition, display 13 is a liquid crystal display and a display table is also stored in memory 55 for properly selecting display segments to form various selected alphanumeric display characters. Programmable read only memory 55 is also connected to address bus 52 at its address port and to data bus 53 at its data port.

Once electrical power is applied to the time keeping system, microprocessor 50 will fetch a starting address from programmable read-only memory 55, this address being the one in which the system operating program stored in memory 55 begins. As soon as microprocessor 50 has this address, that processor will begin to respond to commands listed in that operating program, and will continually manage and monitor the timekeeping system circuitry. Primarily, among these program directives, microprocessor 50 attempts to match the current time (to be supplied thereto by a real time clock as will be described below) with any of the times stored in the format tables contained in memory 55. If one of the stored times matches the current time, microprocessor 50 will then fetch from the format tables the associated audio storage compact disc player 18 track, or audio storage programmable read-only memory 18' start and stop addresses, and transmit this information data to either the player or the memory to begin having it provide the data for the selected chime or musical passage.

As indicated, a real time clock, 56, is used to provide all of the timekeeping duties in the timekeeping system. Real time clock 56 is connected to microprocessor 50 in FIG. 6 by address bus 52 at its address port, to data bus 53 at its data port, and by an interrupt line at an interrupt output thereof. On a provision of electrical power to the circuitry of the timekeeping system, microprocessor 50 will provide data to real time clock 56 indicating that it should begin operating with a time of 12:00:00 a.m. Thereafter, real time clock 56 will maintain the current time through its internal circuitry based on its crystal controlled oscillator establishing its time base. If the user of the timekeeping system should change the times through entries of key pad 14, microprocessor 50 will load this new data into real time clock 56, which will then continue to keep current time from this newly introduced time reference.

Once every second, real time clock 56 generates an interrupt (the "second interrupt") on the single line connecting it to the corresponding interrupt input on microprocessor 50 thereby indicating another time passage increment of one second having occurred. Microprocessor 50 responds on each such occurrence by obtaining the current time from real time clock 56 over data bus 53, and so begins another comparison of this newly obtained current time value with the format table time values stored in programmable read-only memory 55 to determine when the audio storage source used should next begin supplying audio information data.

Real time clock 56 is also supplied electrical power through the same capacitor and diode used in connection with random-access memory 54 to assure its ability to operate until sufficient discharging of the capacitor occurs following a loss of electrical power. Thus, the actual time will also be of available to microprocessor 50 in that discharge period should electrical power be resupplied before too great a discharge of that capacitor to thereby begin again accurate operation of the timekeeping system circuitry.

Microprocessor 50 operates control registers in which it sets logic values to form signals used to direct operation of other system components in the timekeeping system, and a status register in which it keeps track of the status of the timekeeping system. Each of these registers are 8 bit registers. Microprocessor 50 is connected to these control registers and the status register by data bus 53 in FIGS. 6A and 6B.

The first of these control registers, 57, also indicated to be control register 1 in FIG. 6B, supplies a first signal labeled AUDIO OFF which is used to switch on and off electrical power to an audio amplifier used to drive loudspeakers 19 to be described below. Control register 1 provides another signal, LIGHT CONTROL, for switching the backlight of liquid crystal display 13 on or off. A further signal supplied thereby, CD POWER CONTROL, switches electrical power on and off to audio storage compact disc player 18, and to an audio controller to be described below. Finally, four signals on a bus, used to control the supply of electrical power to the various analog clock displays in time display 17 through a clock controller to be described below, are provided by control register 1 to that clock controller.

The second control register, 58, also designated control register 2 in FIG. 6A, has two output buses, one going to the audio controller to be described below and the other going to the liquid crystal display controller also to be described below. Each bus has three lines, one for data, one a clock control line to control loading of the data, and an enable line.

The status register, designated 59 in FIG. 6B, receives several signals indicating the status of various control signals which can then be checked as needed by microprocessor 50. The BATTERY LOW signal over two lines indicates both (a) a loss of primary power with the result that the voltage into the power control to be described below is below 7.2 volts, and (b) a drop in battery voltage below 7.8 volts in situations where primary electrical power to the timekeeping system has not been lost. The next three control signals monitored, CD POWER CONTROL, LIGHT CONTROL, and AUDIO OFF, have been previously described in connection with control register 1. The signal PEAK AUDIO DETECTOR is the output signal of an audio level peak detector which indicates whether an audio output signal is currently being detected or not, which will be referred to below. Finally, the signal ADC CONVERSION DONE contains information as to the completion of a conversion of a value in an analog signal to a corresponding digital value by an analog-to-digital converter to be described below.

A control/decode logic circuit, 60, is connected in FIG. 6A to, and decodes signals on, address bus 52. If an address associated with another subsystem block, to which an output of circuit 60 is connected in FIG. 6 has been decoded, control/decode logic circuit 60 generates an enable signal which is sent to the block so addressed. This permits microprocessor 50 to send or retrieve data from that block.

As directed by microprocessor 50 through register 57, a clock controller, 61, in FIG. 6B supplies electrical power to the four independently controlled clock motors, each configured as shown in FIG. 3, to operate the four analog clock displays in time display 17: the main hour and minute clock, the day of the week clock, the moon position clock, and the moon phase clock. The main clock, as are all the analog clocks in display 17, is set to an initial position manually to match the correct current time at the setting occurrence, which is also kept by real time clock 56 and microprocessor 50 and can be displayed on liquid crystal display 13. The main clock always runs continuously after electrical power has been supplied to the timekeeping system so that the setting of that clock to the proper time (typically matching the current time that can be displayed on the digital clock shown in display 13) will start that clock keeping correct time.

However, as indicated above in connection with the description of the independently controlled clock motor of FIG. 3, such independently controlled clock motors operating the analog display clocks are each operated with a self-contained and independent time base provided by an oscillator in that arrangement. Since the crystal in the crystal controlled oscillator in an independently controlled clock motor will never exactly match the crystal in real time clock 56, and given the passage of sufficient time, the occurrences of rotations of the rotor in an independently controlled clock motor used in display 17 will begin to diverge in time from the appearances of "second interrupts" from real time clock 56, rather than occurring essentially simultaneously, if not resynchronized.

Thus, in FIG. 7A, the one Hertz sequence of pulses representing the "second interrupts" provided by real time clock 56 to microprocessor 50 is shown in solid line form. The one second time duration equivalent angular rotation occurrences of a clock motor rotor in an actuator 23 are shown in dashed lines indicating that the time drift between the crystals of the oscillators in each is such as to cause these motor rotation occurrences to lag behind the real time Clock "second interrupt" pulses. The opposite situation is shown in FIG. 7B where the rotor rotation occurrences lead the "second interrupt" pulses from real time clock 56. In either of FIGS. 7A and 7B, the gap between the dashed line pulses and the solid pulses will grow over time as the crystals (or other oscillator circuit components) in real time clock 56 and the independently controlled clock motors used in display 17 continue to cause the oscillators therein to drift apart in time.

Since the maximum oscillation frequency drift rate for these crystals over time is known and can be specified, the timekeeping system of FIGS. 1 and 2 can resynchronize the main clock independently controlled clock motor rotor rotations with the one Hertz "second interrupts" of real time clock 56 by simply turning power off to the main clock independently controlled clock motor more often than the amount of time required for the drift in oscillator frequency differences to exceed half the period of a cycle in the sequence of real time clock "second interrupt" pulses. The desired resynchronization is thus achieved since, as described above, the application of electrical power to a independently controlled clock motor almost immediately causes a rotation of the rotor in the clock motor therein. Since the termination of electrical power to the main clock independently controlled clock motor can be made to occur essentially in conjunction with a "second interrupt" pulse from real time clock 56, and since such electrical power can be reapplied in just milliseconds while still obtaining the rotation of the clock motor rotor, there is, as a result of such a power termination, an effective resynchronization achieved between the rotor rotations of the main clock independently controlled clock motor and the "second interrupts" provided by real time clock 56.

The same resynchronization procedure can be used with the independently controlled clock motors for the other three analog clocks, but there is no necessity for specially providing such an arrangement for these other three clocks as there is with the main clock. This is true because of the manner in which the other three clocks have their effective rotation rates slowed to the point of keeping them matched to the time relationships they depict, all of which are based on time bases of a much lower frequency then 1 Hertz.

As indicated above, actuator 23, in an independently controlled clock motor of the nature described in connection with FIG. 3, has a rotor which completes a rotation every two seconds, and further has gearing arrangements with concentrically mounted, cylindrical shell shafts one of which rotates fully once a minute, another which completes a rotation once an hour, and a final one completing a rotation once every twelve hours. However, the twelve hour clock motor shaft can be controlled so that it completes a rotation in one week instead of 12 hours to establish the proper drive arrangement for operating the day clock. This is accomplished by stopping the movement of the 12 hour shaft for a total of six and a half days every week through terminating electrical power to the independently controlled clock motor for the day clock for that period of time.

Alternatively, electrical power to the independently controlled clock motor for the day clock can be supplied and withheld in a ratio of power on for one duration and power off for 13 similar durations. The latter method will make the lack of motion in the analog display for the day clock unnoticeable to an observer if the durations chosen are sufficiently brief. Thus, if the independently controlled clock motor for the day clock is supplied electrical power for one minute and no electrical power for the next 13 minutes, and this pattern is repeated continuously, the day clock will appear to move smoothly because 14 minutes is a very small increment of the time in a total week, which then becomes the period of rotation of the 12 hour clock shaft and so of the hand driven thereby over the week based dial face use with the day clock. Microprocessor 50 and programmable read only memory 55 can be easily programmed to provide this on-off pattern of electrical power supply to the day clock independently controlled clock motor.

Another electrical power on-off pattern that can be usefully employed is to have the desired ratio of electrical power on and off times accomplished within every minute or within every hour that the day clock is used. In this situation, the day clock independently controlled clock motor is to be supplied electrical power for one fourteenth of every hour, or 257.14286 seconds. However, typically, an independently controlled clock motor operates only in integer seconds so that a residual error accumulates every hour totalling a fraction of a second (0.14286) if the day clock independently controlled clock motor is supplied electrical power for possible integer 257 seconds each hour.

On the other hand, this accumulation can be easily compensated by having power supplied for an extra period of time to the day clock independently controlled clock motor once a day. Thus, after a day has passed, an accumulative error of 3.42857 seconds ($0.14286 \times 24$) has accumulated, and 3 seconds of this can be compensated by supplying electrical power to this independently controlled clock motor for an extra 3 seconds once per day. If the result in diminished error (0.42857 seconds per day) needs to be further reduced, additional corrections can be introduced in a similar fashion once a week, or once a month, or even once a year. In most situations, the value of such extra corrections is quickly diminished as accumulative error quickly becomes less than the intrinsic accuracy of the crystal in the day clock independently controlled clock motor itself.

Similar principles apply to creating the movements of the dials which rotate in synchronism with the rotation of the moon about the earth, and with the phases of the moon. In the moon position clock, the rotation of the earth under the moon plus the motion of the moon during its rotation results in a cycle lasting 24 hours, 50 minutes, and 28 seconds. Assuming the dial on the 12 hour clock shaft is used, the moon position independently controlled clock motor would need to be supplied electrical power 28.98421 seconds every minute with no power being supplied for the remainder of the minute. Since, again, most such independently controlled clock motors operate on integer seconds only, the moon position clock motor and control circuit can be supplied electrical power for 29 seconds leaving an accumulating error of 0.01579 seconds every minute. This is the same as 22.73651 seconds every day which can be easily corrected by reducing the time electrical power is supplied by 23 seconds during some point in each day. Of course, further corrections can be made as indicated above if thought desired. Hence, such independently controlled clock motors can be made to keep time on any desired time base by microprocessor 50 and memory 55 through the foregoing methods.

As indicated above, audio storage compact disc player 18 (or audio storage programmable read-only memory 18') is controlled at an output port of microprocessor 50 over a serial communication line. The actual command codes recognized by player 18 for operation are stored in programmable read-only memory 55. The command codes are initially read from the programmable read-only memory by microprocessor 50, and the proper commands for player 18 are then assembled in microprocessor 50 and transmitted serially out of the microprocessor port to player 18. Thus, microprocessor 50 is directly the controller for audio storage compact disc player 18 (or audio storage programmable read-only memory 18'). Storing the command codes appropriate to the choice of a compact disc player to service player 18 permits a wide variety of such players to be used through merely changing the corresponding command table in memory 55. Since the commands stored in memory 55 for audio storage compact disc player 18 are sufficient to control starting, stopping, pausing, and advancing that player, microprocessor 50 can start the player retrieving data from its compact disc at any programmed time, and the data can be selected easily through directing the player to provide data from the selected track.

Electrical power to audio storage compact disc player 18 is controlled by a compact disc player power switch, 62, in FIG. 6A which receives a power input and the control signal CD POWER CONTROL. Of course, this control signal is supplied by microprocessor 50 to register 57 so that it can indeed totally control audio storage compact disc player 18.

A liquid crystal display controller, 63, controls liquid crystal display 13 segment by segment to thereby control which alphanumeric characters are displayed in each segment character provided therein. The system allows the master time kept by real time clock 56 to be displayed in display 13, as indicated above, and the nighttime starting and ending times for turning down the volume of the chimes to be heard through adjusting the audio controller to be described below. These times are set by position of wipers on the pair of potentiometers through manipulating appropriate buttons in control panel 12. Also, chimes can be caused to be played at any set time through controlling a potentiometer in control panel 12 to thereby allow the clock to serve as an alarm. In addition, display 13 can permit track and melody selection information to be displayed thereon, all under the control of microprocessor 50 operating through register 58.

An analog-to-digital converter, 64, is used to convert analog potentiometer settings into corresponding digital signals. The converter used is a 8 bit converter having a linearity of plus or minus the least significant bit, and can complete a conversion time 50 $\mu$ s. Microprocessor 50 directs converter 64 over address bus 52 to switch its input to the analog signal source to be converted through a multiplexing arrangement in the converter, and to convert the analog value received after such switching. Microprocessor 50 checks register 59 to determine such a conversion is done. Thereafter, microprocessor 50 reads the data related to the conversion on data base 53.

The multiplexing arrangement in converter 64 allows switching between the analog voltages supplied by the day volume and night volume potentiometers 15 and 16 and, in addition, to the settings for the potentiometers used for choosing the bass and treble levels for the audio and for the balance between the midrange speakers, these audio control being set by positioning wipers on potentiometer mounted internally to the timekeeping system but which could be made available in control panel 12. The various data for controlling the audio so obtained by microprocessor 50 is then inserted in register 58 where control signals are transmitted to an audio controller, 65.

Audio controller 65 in FIG. 6B is, as stated, used to adjust the volume, treble, bass and speaker volume balance in the analog audio signals provided by audio storage compact disk player 18 (or audio storage programmable read only memory 18') as the AUDIO IN signals supplied to audio controller 65. These two analog stereophonic signals, as adjusted by audio controller 65, are then transmitted to an audio amplifier, 66. As indicated, audio controller 65 is controlled by microprocessor 50 through register 58 over the bus extending therebetween, and through register 57 which controls the power drawn by audio controller 65 through a switch in that controller with the signal CD POWER CONTROL.

Audio amplifier 66 is a fixed gain (10) audio amplifier. Amplifier 66 receives the analog audio signals from controller 65, amplifies them, and provides them to loudspeakers 19. One of the analog stereophonic signals is supplied to the right midrange speaker, and the remaining one is supplied to both the left midrange speaker and the bass speaker. Microprocessor 50, during times of audio inactivity, can shut off amplifier 66 through register 57 by directing the proper signal AUDIO OFF to amplifier 66. An audio activity detector, 67, or audio level peak detector, is used to detect a signal being transmitted over the wire to the left midrange speaker and the bass speaker to monitor the presence of audio activity. The signal from detector 67, as indicated above, is then provided to status register 59 to indicate the presence or absence of such audio activity. Through monitoring audio activity, microprocessor 50 can switch off portions of the timekeeping circuit not being used in the absence of audio to conserve power including stopping any play of audio storage compact disk player 18. Also, many compact disc players have the capability to be programmed to play a selected track, or a selected series of tracks, and to then stop once such play is completed so as to require no outside commands to be shut off.

Power for various portions of timekeeping circuitry is provided as appropriate to such portions by power controller, 68, receiving the BATTERY IN input from battery power supply 11. Power controller 68 also has the circuitry for monitoring battery voltage, and provides the information resulting from such monitoring to status register 59 as described above.

Figure 8A:
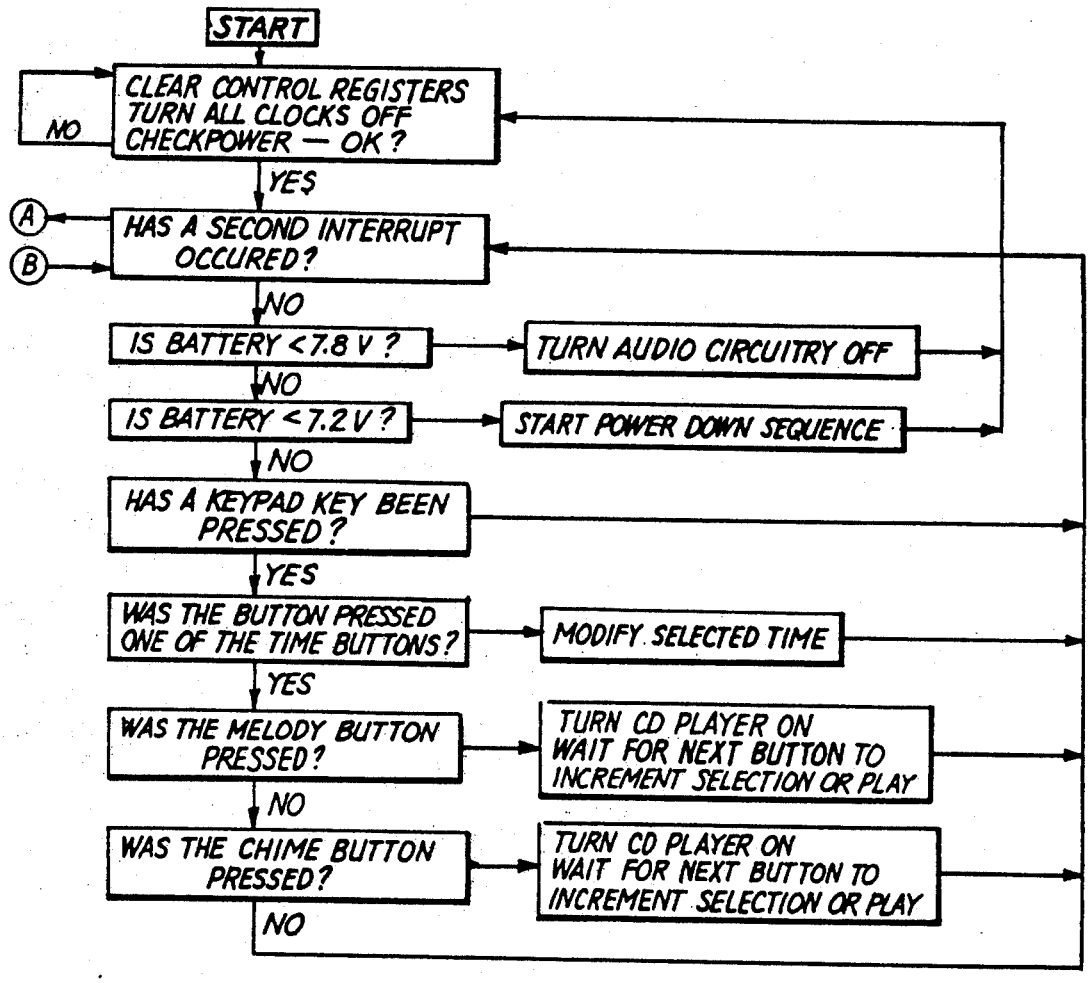
FIGS. 8A and 8B show a flow chart describing operations in the system of the present invention.
Figure 8B:
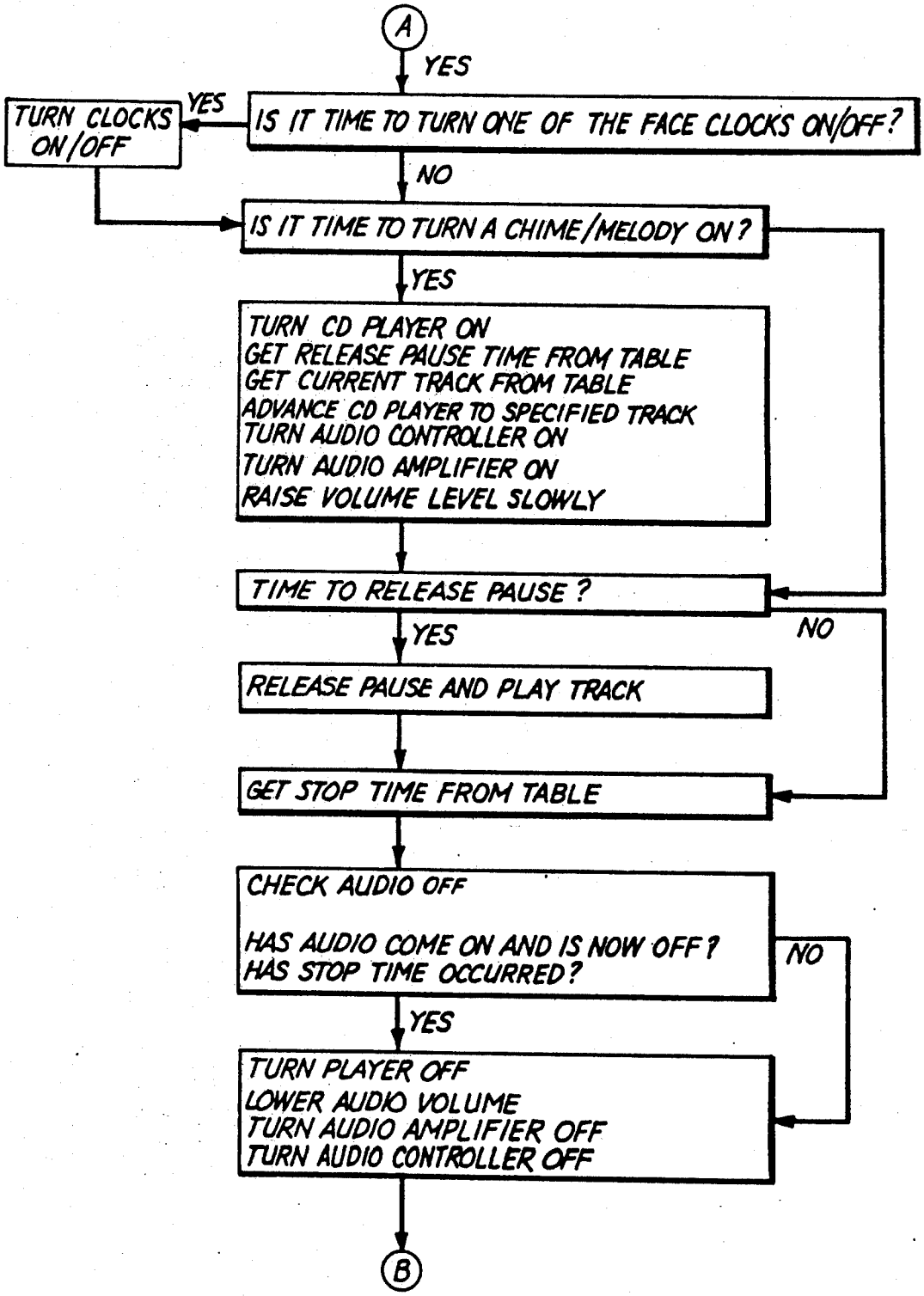

A general operation flow chart is shown in FIGS. 8A and 8B for system controller 10. Though much detail is omitted, the general flow of operation of the system is presented along the lines described in the foregoing text. The chart is specifically directed toward the use of a compact disk player for the audio information storage rather than a programmable read only memory.

Although the present invention has been described with reference to preferred embodiments, workers skilled in the art will recognize that changes may be made in form and detail without departing from the spirit and scope of the invention.

What is claimed is:

1. A timekeeping system for providing selected ones of a plurality of audio signal selections, based on stored audio information, synchronized with selected time events, said plurality of audio signal selections differing in time duration from one another, said system comprising:

a timing signal generating means having an output and capable of providing a timing signal at said output thereof containing repeated cycles at a fundamental frequency;

a memory means having a control input and an output and capable of storing therein a plurality of audio data assemblages from which can be provided corresponding ones of said audio signal selections, said plurality of audio data assemblages each being stored with a corresponding blank data assemblage such that together they form a corresponding duration data assemblage resulting in a plurality of duration data assemblages each corresponding to one of said audio signal selections and each of which require a predetermined passage time duration to be entirely provided at said memory means output which is equal to or greater than that required to so provide just that said audio data assemblage contained therein, said memory means providing being capable of providing a selected one of said plurality of duration data assemblages at said output thereof in response to corresponding selection signals being provided at said control input thereof; and a controller means having a first input electrically connected to said timing signal generator means output and a first output electrically connected to said memory means control input, said controller means being capable of receiving said timing signal and of determining occurrences of said time events based on numbers of said cycles having occurred in said timing signal, said controller means being further capable of providing memory direction signals at said first output thereof to direct said memory means to provide a selected duration data assemblage at said output thereof beginning at a time fixed with respect to a selected said time event.

2. The apparatus of claim 1 further comprising a rotator means having an input and having a rotatable output structure, said rotator means being capable of providing periodic angular rotations of a selected angular value of said output structure thereof in response to electrical energization of said input thereof; and yet further comprising an electrical power switching means having an output electrically connected to said rotator means input, a power input suited for electrical connection to a source of electrical power, and a control input electrically connected to a second output of said controller means through which said power switch means is capable of being selectively directed to transfer, or block transfer of, electrical power between said power input thereof and said output thereof; and wherein said controller means is further capable of providing selected signals at said second output thereof to cause said electrical power switch to transfer electrical power to said rotator means to result in periodic angular rotation of said rotator means output structure.

3. A method for providing selected ones of a plurality of audio signal selections based on stored audio information synchronized with selected time events, said method comprising:

storing audio information for said plurality of audio signal selections in a memory means as a plurality of duration data assemblages each comprised of an audio data assemblage from which can be provided a corresponding one of said plurality of said audio signal selections and of a corresponding duration data assemblage which together require a predetermined passage time duration to be entirely provided at an output of said memory means which is equal to or greater than that required to so provide just that said audio data assemblage contained therein;

providing a timing signal containing repeated cycles at a fundamental frequency;

selecting one of said audio signal selections to be provided at a selected said time event;

determining occurrence of said selected time event based on numbers of said cycles having occurred in said timing signal; and providing that said duration data assemblage corresponding to said audio signal selection previously selected from said memory means output beginning at a time fixed with respect to said selected time event.

4. The method of claim 3 wherein said storing of audio information for said plurality of audio signal selections in a memory means is preceded by recording an acoustic signal selection, removing unwanted components of said acoustic signal selection, and storing a said audio data assemblage corresponding to said acoustic signal selection.

5. A synchronizing system for synchronizing angular positions of a rotatable output structure of a rotator means having independent periodic rotation timing, said system comprising:

a timing signal generating means having an output and capable of providing a timing signal at said output thereof containing repeated cycles at a fundamental frequency;

a said rotator means having an input and having a rotatable output structure, said rotator means being capable of causing periodic angular rotation of said output structure with a selected angular value, and determining duration of a rotation period therefor, in response to electrical energization of said input thereof following an initial angular rotation of said output structure of said selected angular value occurring in a time following said electrical energization which is small compared to that reciprocal value of said fundamental frequency;

an electrical power switching means having an output electrically connected to a said input of said rotator means, a power input suited for electrical connection to a source of electrical power, and a control input through which said power switching means is capable of being selectively directed to transfer, or block transfers of, electrical power between said power input thereof and said output thereof; and a controller means having an input electrically connected to said timing signal generator means output and an output electrically connected to said control input of said power switching means, said controller means, being capable of directing said power switching means between transferring electrical power between said power input and said output thereof and blocking such transfers, being also capable of directing said power switching means to at least temporarily block such a transfer prior to changes in said rotation period exceeding a selected fraction of that reciprocal value of said fundamental frequency.

6. A synchronizing system for synchronizing an output of a display means having independent periodic output change timing, said system comprising:

a timing signal generating means having an output and capable of providing a timing signal at said output thereof containing repeated cycles at a fundamental frequency;

a said display means having an input and having a changeable output, said display means being capable of causing periodic changes of said output, and determining duration of a change period therefor, in response to electrical energization of said input thereof following an initial change of said output in a time following said electrical energization which is small compared to that reciprocal value of said fundamental frequency;

an electrical power switching means having an output electrically connected to a said input of said display means, a power input suited for electrical connection to a source of electrical power, and a control input through which said power switching means is capable of being selectively directed to transfer, or block transfers of, electrical power between said power input thereof and said output thereof; and a controller means having an input electrically connected to said timing signal generator means output and an output electrically connected to said control input of said power switching means, said controller means, being capable of directing said power switching means between transferring electrical power between said power input and said output thereof and blocking such transfers, being also capable of directing said power switching means to at least temporarily block such a transfer prior to changes in said change period exceeding a selected fraction of that reciprocal value of said fundamental frequency.

7. A time base shifting system for providing a selected effective period for angular rotation of a selected angular value of an output structure of a rotator means having an independent time base, said system comprising:

a said rotator means having an input and a rotatable output structure, said rotator means being capable of causing periodic angular rotations of said output structure, with duration of a rotation period being determined therein and with a selected angular value, in response to electrical energization of said input thereof;

an electrical power switching means having an output electrically connected to a said input of said rotator means, a power input suited for electrical connection to a source of electrical power, and a control input through which said power switching means is capable of being selectively directed to transfer, or block the transfer of, electrical power between said power input thereof and said output thereof; and a controller means having an output electrically connected to said control input of said power switching means, said controller means, being capable of directing said power switching means between transferring electrical power between said power input and said output thereof and blocking such transfers, being also capable of directing said power switching means to at least temporarily block such a transfer periodically during successive sets of rotation periods.

* * * * *